US005107555A

United States Patent [19]

Thrasher

[11] Patent Number: 5,107,555

[45] Date of Patent: Apr. 28, 1992

[54] CRIB ROCKING ASSEMBLY

[76] Inventor: Mickey L. Thrasher, 1125 S. Clifton, Fulton, Miss. 38843

[21] Appl. No.: 626,479

[22] Filed: Dec. 12, 1990

[51] Int. Cl.[5] ..... A47D 9/02

[52] U.S. Cl. ..... 5/109; 5/107; 5/108

[58] Field of Search ..... 5/101, 107-109; 128/33

[56] References Cited

U.S. PATENT DOCUMENTS

| | | | |
|---|---|---|---|
| 1,662,754 | 3/1928 | Millard . | |
| 1,909,204 | 5/1933 | Marchese | 5/109 |
| 2,689,355 | 9/1954 | De Frank . | |
| 2,767,799 | 10/1956 | Ring . | |
| 2,841,802 | 7/1958 | Leverett | 5/109 |
| 3,031,686 | 5/1962 | Muzzey | 5/109 |
| 3,952,343 | 4/1976 | Wong | 5/109 |
| 4,146,885 | 3/1979 | Lawson, Jr. | 5/108 X |
| 4,752,980 | 6/1988 | Nafte | 5/108 X |
| 4,970,740 | 11/1990 | Crawford | 5/109 |
| 4,985,627 | 9/1990 | Park | 128/33 |

*Primary Examiner*—Michael F. Trettel
*Attorney, Agent, or Firm*—Terry M. Gernstein

[57] ABSTRACT

A crib assembly includes a rocking assembly which rocks the crib mattress either up and down in a vertical plane or side to side in a horizontal plane. The rocking assembly can be either manually activated or automatically activated if the child cries out. The rocking assembly will shut off after a preset time interval, but can be reactivated if the child is still crying at the end of that preset interval. However, if the rocking assembly is reactivated, an alarm circuit is activated by the second activation of the rocking assembly, and this alarm circuit will alert an adult that one rocking cycle was unsuccessful in helping the child to return to sleep.

14 Claims, 7 Drawing Sheets

CRIB ROCKING ASSEMBLY

TECHNICAL FIELD OF THE INVENTION

The present invention relates to the general art of bedding, and to the particular field of cribs.

BACKGROUND OF THE INVENTION

Many babies, especially newborn infants, do not sleep completely through the night. These children wake up and, because of fright, hunger, or some other reason, often cry out. Often the awakened child will quickly go back to sleep on his own.

However, there are instances when an awakened child must be comforted before he will return to sleep. This comforting often takes the form of gentle rocking by a parent. This comforting requires the parent to be awakened from his own sleep. Once awakened, especially under the just-mentioned circumstances, many adults find it extremely difficult, if not impossible, to return to sleep. Even if the adult returns to sleep, since their sleeping pattern has been interrupted, the overall night's sleep is not entirely restful. Since many adults work, this is not a desirable situation.

For this reason, the art has included devices which are intended to comfort an awakened child, and help that child to return to sleep. While successful in some instances, these devices still have several shortcomings which have inhibited the full commercial acceptance and success of these devices.

For example, since all children are different, some children may be more receptive to a back and forth rocking motion than to an up and down rocking motion, or vice versa. Many presently available devices are not amenable to being customized to the exact needs and desires of a particular child, and thus may not be universally acceptable.

Still further, many of the present devices still require someone to manually activate the device. Once activated, the device operates continuously. However, the manual activation may require a parent to be awakened, and to have to move into a different room to activate the device. Such requirement defeats one of the main objects of these devices, to wit: permitting a child to be comforted without requiring an adult to have his sleep interrupted, even for a little bit. Additionally, once activated, many of the present devices must be manually shut off.

If a device that is intended to comfort a child touches that child, and does so after the child has returned to sleep, the device, itself, may actually interfere with the child's sleep. If an adult is required to de-activate the device, the adult will have his sleep interrupted not once, but twice, which is often worse than being interrupted for a lengthy time but only having one interruption.

In some cases, the parent should be awakened. A principal example of such a case is where the child is ill or hungry. In such cases, the mere comforting of the child will be insufficient, and in the case of illness, can be harmful since medical attention is not being administered. Therefore, those devices that only comfort a child, even if a parent is not awakened, but do not have any means for alerting the parent of an unusual situation, are inadequate.

Therefore, there is a need for a child comforting assembly which can be operated without requiring another individual to activate the device, and which will provide comfort and attention that can be customized for a particular child, yet which will not interfere with the child's sleep and which can alert an adult if the comforting is insufficient.

OBJECTS OF THE INVENTION

It is a main object of the present invention is to provide a child comforting assembly which can be operated without requiring another individual to activate the device.

It is another object of the present invention to provide a child comforting assembly which can be operated without requiring another individual to activate the device.

It is another object of the present invention to provide a child comforting assembly which can be operated without requiring another individual to activate the device, and which will provide comfort and attention that can be customized for a particular child.

It is another object of the present invention to provide a child comforting assembly which can be operated without requiring another individual to activate the device, and which will provide comfort and attention that can be customized for a particular child, yet which will not interfere with the child's sleep.

It is another object of the present invention to provide a child comforting assembly which can be operated without requiring another individual to activate the device, and which will provide comfort and attention that can be customized for a particular child, yet which will not interfere with the child's sleep and which can alert an adult if the comforting is insufficient.

SUMMARY OF THE INVENTION

These, and other, objects are achieved by a crib assembly which includes a plate on which a mattress rests. The plate is connected to a rocking assembly which can rock the mattress in either a vertical up and down motion or a horizontal side to side motion. The rocking assembly can be activated manually or by means of a voice activated switch. In either case, the rocking assembly includes a timer system to automatically shut off after a preset time interval. If, at the end of the pre-set time interval, the child is still crying, the assembly will continue to operate for another pre-set interval. However, an overall timer is activated when the assembly is first activated, and if the child is still crying after a certain time, an alarm is sounded to awaken an adult. In such a case, the comforting provided by the rocking motion is not working, and this may indicate a situation which requires the attention of an adult. In this manner, the assembly can be operated without the immediate attention of an adult, yet will shut off so as not to interfere with the child's sleep, and yet will alert an adult of a possible need for his attention.

The selection of either vertical or horizontal rocking for a selected time period permits the assembly to be customized for a particular child. Still further, since all children do not cry at the same level, the automatic activation system can also be customized for the particular child. In this manner, the assembly can be customized to fit the exact needs of the child.

All of these features make the assembly of the present invention extremely versatile.

BRIEF DESCRIPTION OF THE DRAWING FIGURES

FIG. 9 is an elevational view taken along line 9—9 of FIG. 8.

DETAILED DESCRIPTION OF THE PREFERRED EMBODIMENT OF THE INVENTION

Figure 1:
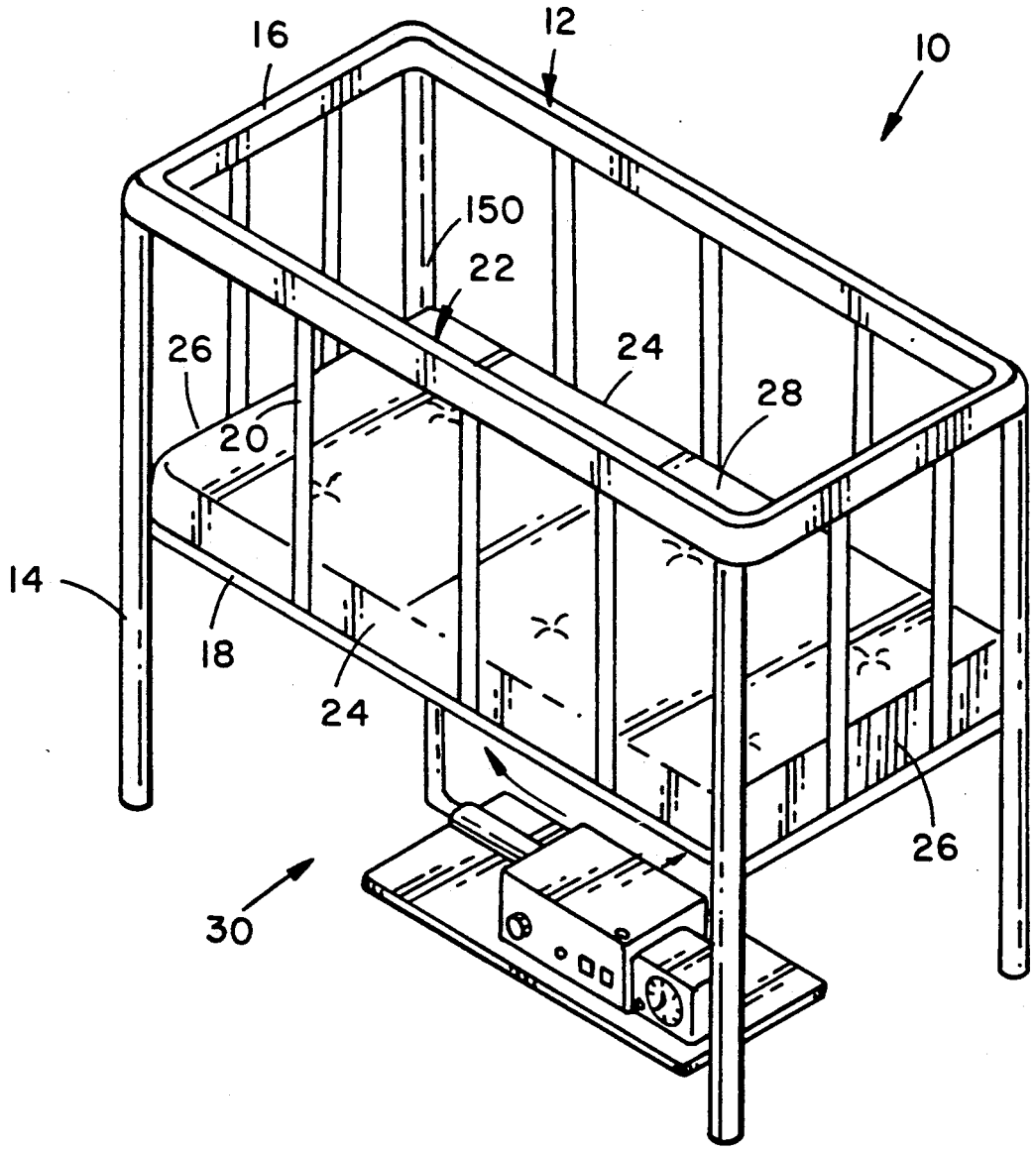
FIG. 1 is a perspective view of a crib having a rocking assembly associated therewith.

Shown in FIG. 1 is a crib assembly 10 embodying the present invention. The crib assembly 10 includes a frame unit 12 having legs, such as leg 14, resting on a supporting surface, such as a floor, and extending vertically upwards therefrom to an upper rim 16 which peripherally surrounds the crib unit. A mattress supporting element 18 is mounted on the legs and extends in the horizontal plane. The crib unit also includes the usual slats, such as slat 20, one of which can be raised or lowered as suitable. A mattress 22 rests on the mattress supporting element and has an outer perimeter defined by sides 24 and ends 26 which is less than the inner perimeter of the frame unit adjacent to the mattress supporting element. As shown in FIG. 1, the mattress is supported above the supporting surface by the frame unit and has an upper surface 28 on which an infant or child rests when that infant or child is in the crib assembly.

Figure 2:
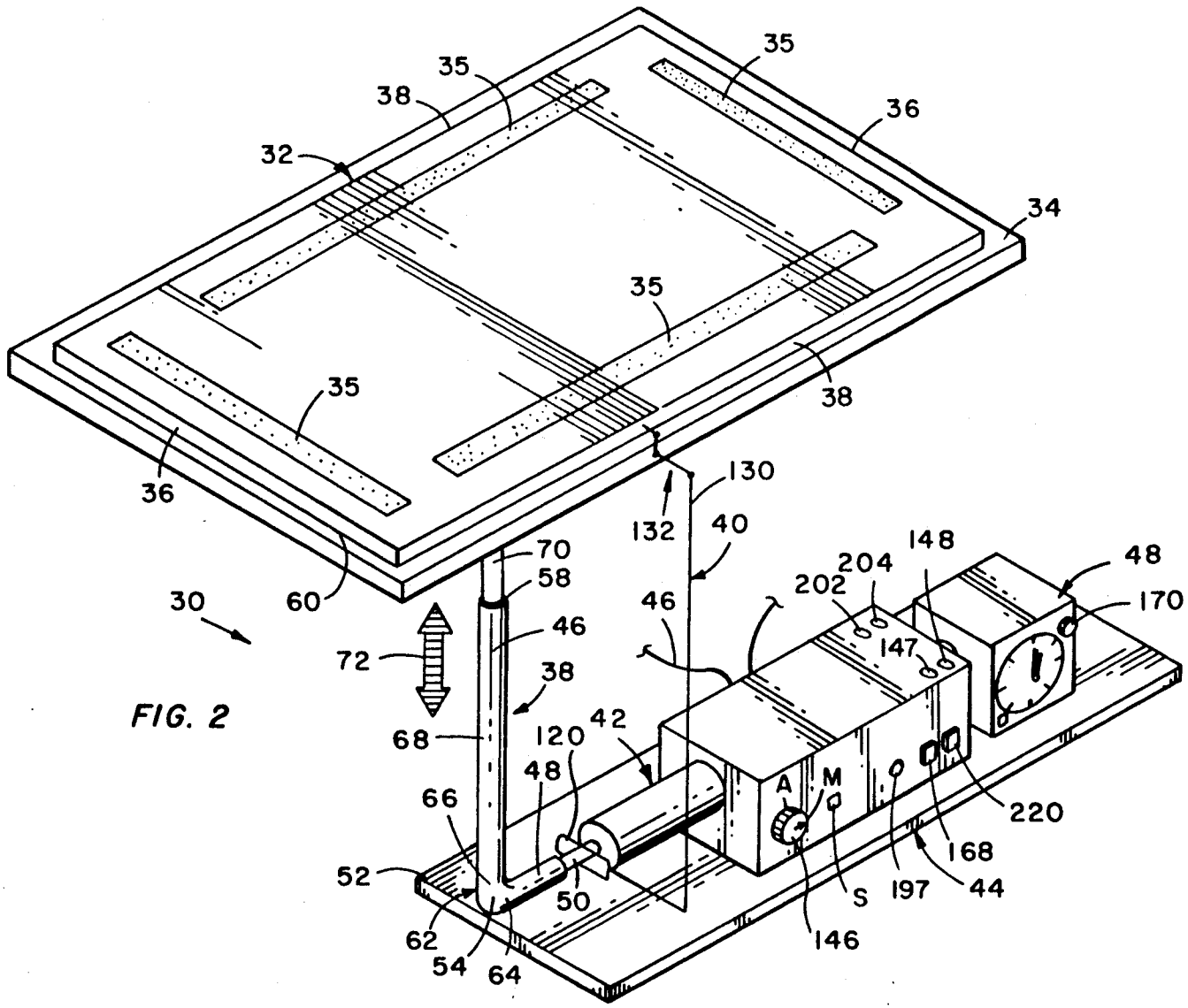
FIG. 2 is a perspective view of the rocking assembly of the present invention.

As is best shown in FIGS. 1 and 2, the crib assembly 10 of the present invention also includes a mattress rocking assembly 30. This mattress rocking assembly can rock the mattress in a vertical plane in an up and down motion or can rock the mattress in a horizontal plane in a side to side motion. This assembly can be activated manually or by the child's cry, and will rock the mattress for a prescribed length of time, and then will shut off. However, if the child is not quiet at the end of a certain time, which can be set to be equal to or longer than the rocking time, in spite of the rocking, the rocking assembly also will activate an alarm that can be used to alert a parent or other person that the child has awakened, is in some distress, and a rocking process has not quieted that child. In such a situation, the adult should check the child to be sure that there is not something wrong, such as an illness or the like.

More specifically, as shown in FIG. 2, the rocking assembly 30 includes a plate 32 which rests on a support element 34. The support element 34 can be the mattress support, or another element that rests on the mattress support element of the crib frame as required. The plate element 32 has a perimeter that is defined by ends 36 and sides 38 thereof, and this plate perimeter is smaller than the outer perimeter of the mattress. The plate fits beneath the mattress between the mattress lower surface and the mattress supporting element or the support plate 34, and includes elements, for attaching the mattress to the plate, such as VELCRO or other such hook-and-loop fastening system strips 35, or the like. The mattress can include corresponding attaching elements, such as strips of VELCRO which correspond in size and position to the strips 35 whereby the mattress can be releasably attached to the plate.

The plate 32 is moved either up and down or side to side to rock the mattress, and the rocking assembly includes a first mechanism 38 for imparting the vertical up and down motion to the mattress, and a second mechanism 40 for imparting the side to side motion to the mattress. A motor 42 is contained in a control unit 44 which also contains the circuit systems necessary to control the operation of the rocking assembly. The motor unit, and the circuit systems are powered by utility power via a power cord 46, and the time of operation is controlled using circuit elements and a manually setable timer 48. Each of these elements will be discussed in detail below. Suitable batteries can be included as required. It is also noted that the size of the mattress vis a vis the frame can be adjusted to permit the side to side motion.

Figure 3:
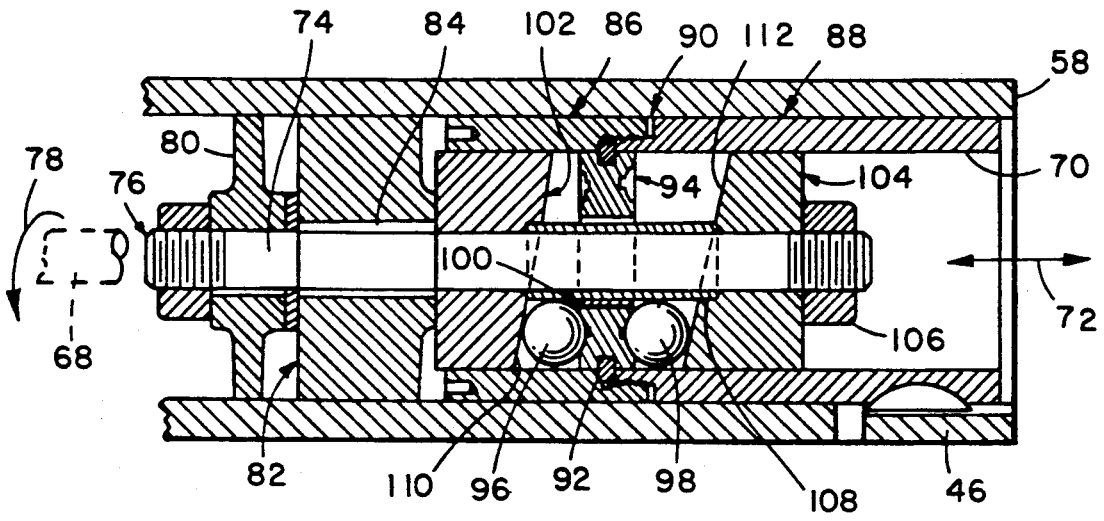
FIG. 3 is a cutaway side elevational view of a first mechanism of the rocking assembly for imparting vertical up and down motion to the crib mattress.

Referring to FIGS. 2 and 3, it is seen that the first mechanism 38 includes an L-shaped tubular housing element 46 connected at its proximal end 48 to a rotating driven output shaft 50 of the motor unit. The housing element 46 is supported on a mounting plate 52 near proximal end 50 and near elbow 54, and extends vertically upwards to a distal end 58 that is located near lower surface 60 of the plate element 32. The tubular housing element 46 is hollow, and a bevel gear set 62 is located therein near the elbow 54. One bevel gear 64 of the gear set is mounted on a distal end of the motor driven shaft 50 for rotation therewith, and a second bevel gear 66 meshingly engages the first bevel gear. The second bevel gear is fixed to one end of a rotating transfer shaft 68 that extends upwards in the long leg of the L-shaped housing and rotates with the second bevel gear 66 under the influence of the first bevel gear 64 so that the rotation of the motor driven shaft 50 is transferred to a location near the tubular housing distal end 58.

A lower end of a hollow sleeve element 70 is slidably received in the tubular housing element and an upper end of that sleeve element is fixed to the plate element 32. The sleeve element moves up and down in the tubular housing as indicated by arrow 72 under the influence of the rotation of rotation transfer shaft 68.

Referring more specifically to FIG. 3, it is seen that the transfer shaft 68 is connected to a stub shaft 74 via a threaded connection 76 to transfer rotation of the transfer shaft, indicated by arrow 78, to that stub shaft. The stub shaft is supported inside the tubular housing by a spider element 80 and by a bearing element 82 having bearings 84.

The sleeve element 70 includes two sections, section 86 and section 88 which are connected via threaded connection 90. A snap ring 92 is interposed between the two sections and extends into the inner volume of the sleeve.

A collar 94 is affixed to the sleeve via the snap ring for movement therewith. A plurality of roller balls, such as balls 96 and 98 are held in rolling engagement with the collar between a cage 100 and the inner surface of the sleeve. Two truncated cylindrical elements 102 and 104 are located inside the sleeve. The cylindrical elements are keyed to the stub shaft and are slidably positioned in the sleeve to move in the up and down direction indicated by direction of arrow 72, and are held in position by bearing element 82 and a nut !06 threaded onto the end of the stub shaft. A bearing tube 108 surrounds the stub shaft and contacts the roller balls.

The cylindrical elements 102 and 104 include truncated faces 110 and 112 respectively which are oriented to be parallel to each other and which are at a skewed angle with respect to the longitudinal axis of the stub shaft and the rotation transfer shaft.

Stub shaft 74 with the two truncated cylindrical elements 102 and 104 keyed thereto revolves in direction 78 under the influence of the transfer shaft. This rotation is transmitted to the truncated cylindrical elements causing the roller balls in contact with the truncated faces and the race of collar 94 to transmit a reciprocating movement to the sleeve element 70. The balls are kept in alignment by the cage 100 which straddles the collar 94.

Figure 4:
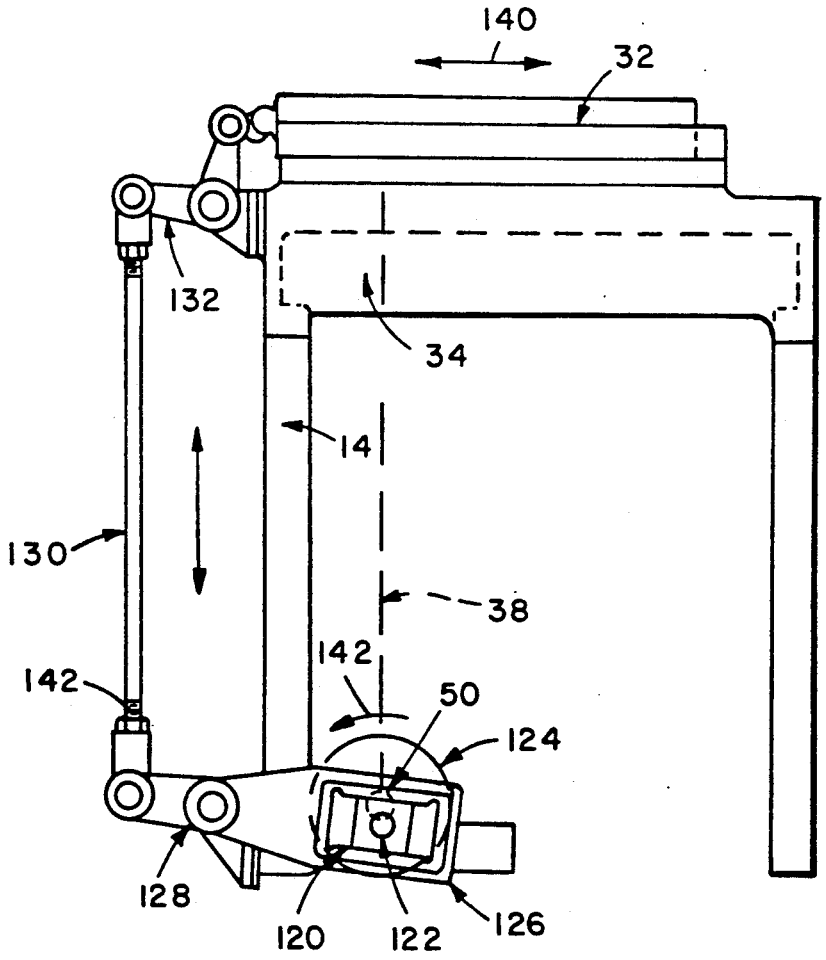
FIG. 4 is an end elevational view of a second mechanism of the rocking assembly for imparting side to side horizontal motion to the crib mattress.

Referring to FIGS. 2 and 4, the second mechanism for transmitting side to side motion to the plate 32 is shown. In the interest of clarity, the second mechanism is not shown in FIG. 1. The second mechanism 40 includes a sliding block 120 that is free to pivot about an eccentric stud 122 which projects from flange 124 on the motor driven output shaft 50. Block 120 slides within a slotted box-like lever 126 pivoting the lever about a shaft 128. A connecting rod 130 joins one end of the lever 126 with a bellcrank lever 132, which, in turn, reciprocates the plate 32 that is mounted in ways provided on the element 34. The side to side reciprocating movement of the plate 32 is indicated in FIG. 4 by arrow 140. The rotary motion of the driven shaft 50 is indicated in FIG. 4 by arrow 142.

Once the rocking assembly is activated, the motor is powered for a predetermined amount of time to either rock the mattress up and down or side to side depending on which rocking motion is most effective for the particular child occupying the crib unit. Selection of the particular type of rocking motion is effected by disconnecting the sleeve 70 from the plate element 32 or by disconnecting rod 130 from the lever 126 at threaded connection 142. Both movements can be simultaneously imparted to the mattress, but the mattress may roll a bit.

Control of the motor is effected by circuit systems shown in 5, 6, 7 and 10. The control can be manual or automatic depending on the position of a manually operated selector switch 146 located on the face of the control unit 44. If a manual operation is desired, the selector switch is moved to position "M", the unit turned on using on/off switch S, and the timer 48 is set and will deactivate the motor upon reaching the end of the set time period.

If automatic operation is desired, the selector switch is set to position "A" and the unit is turned on. This selects an automatic operation which includes use of a timed motor operation circuit MC, best shown in FIG. 5.

Figure 5:
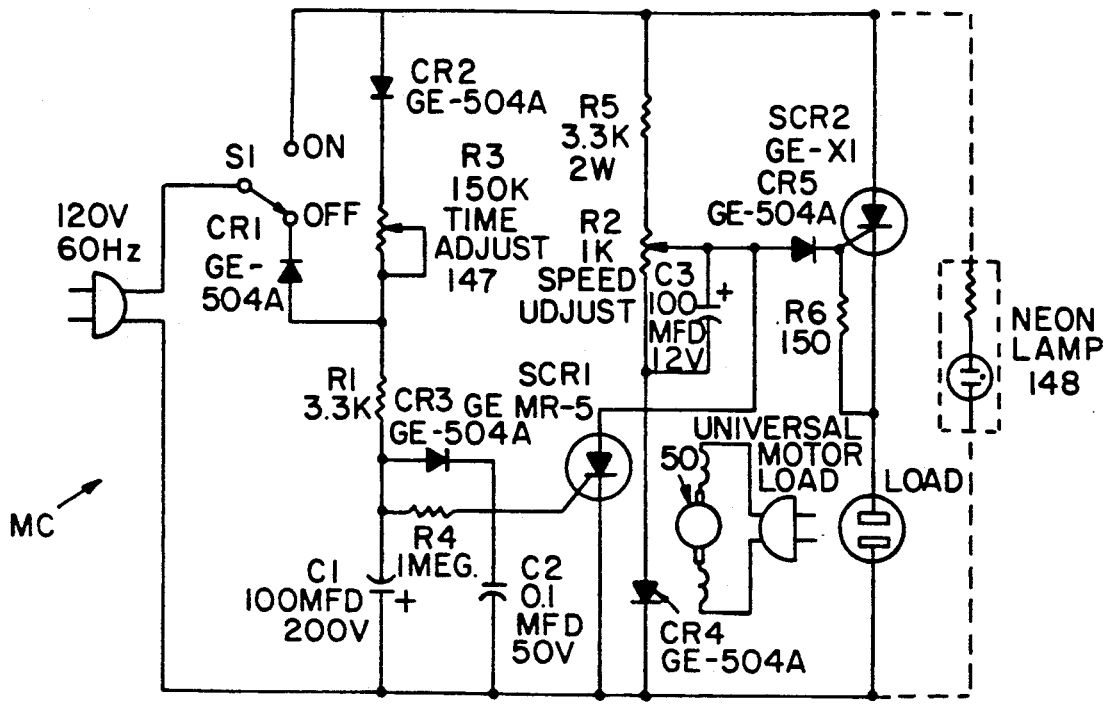
FIG. 5 is a diagram of a circuit which operates a motor of the rocking assembly for a preset time period after activation.

Once activated, the motor will operate for a predetermined period of time, and then shut off. Referring to FIG. 5, when the time delay expires SCR1 conducts and removes the gate signal from SCR2, which stops the motor. Both the time delay and motor speed are adjustable by potentiometers R2 and R3. The capacitance of capacitor C1 can be increased using a setting knob 147 to lengthen the time delay. A lamp 148 located on the unit casing is lit when the motor is in operation.

Figure 6:
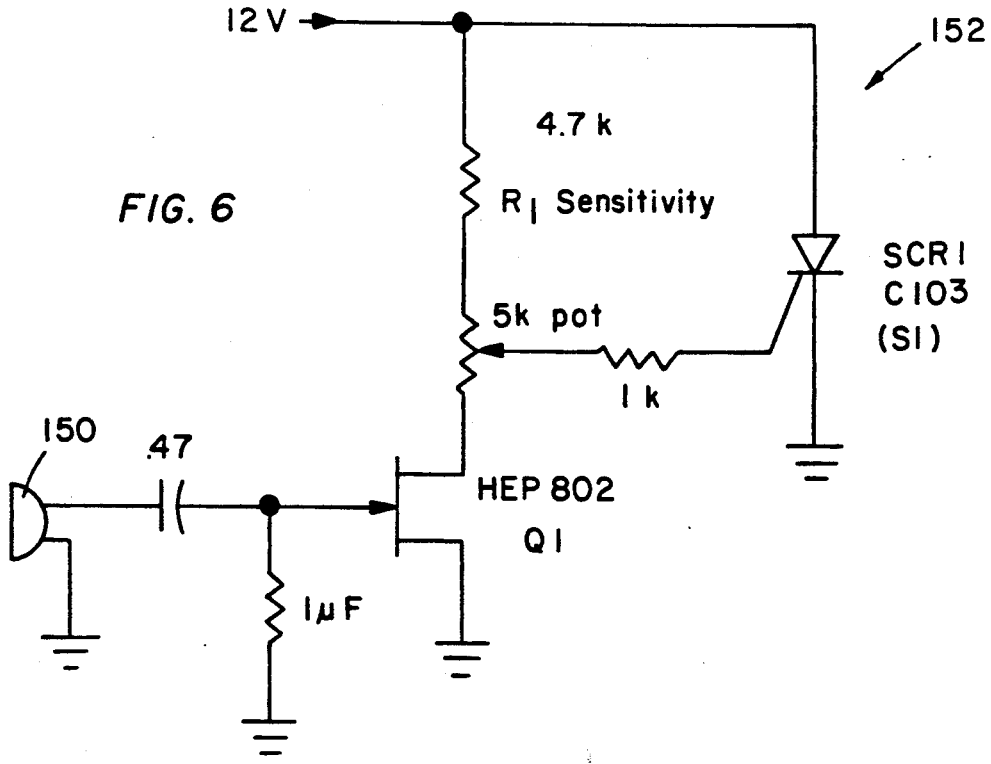
FIG. 6 is a diagram of a circuit which activates the rocking assembly upon sensing a child's cry.

The motor time delay circuit MC shown in FIG. 5 is activated when switch S1 is moved into the "on" position. This occurs when the child cries out. The child's cry is sensed by a microphone 150 mounted on the crib frame. A sound-activated switch circuit system 152 is used to move switch S1 into the "on" position is shown in FIG. 6. The audio from microphone 150 is amplified by Q1. Peaks of signal, adjusted by $R_1$, greater than about 0.7 volts trigger SCR1 which acts as the switch S1 for the circuit MC shown in FIG. 5. Since each child cries at different levels, the circuit 152 can be adjusted for the particular child.

Figure 7:
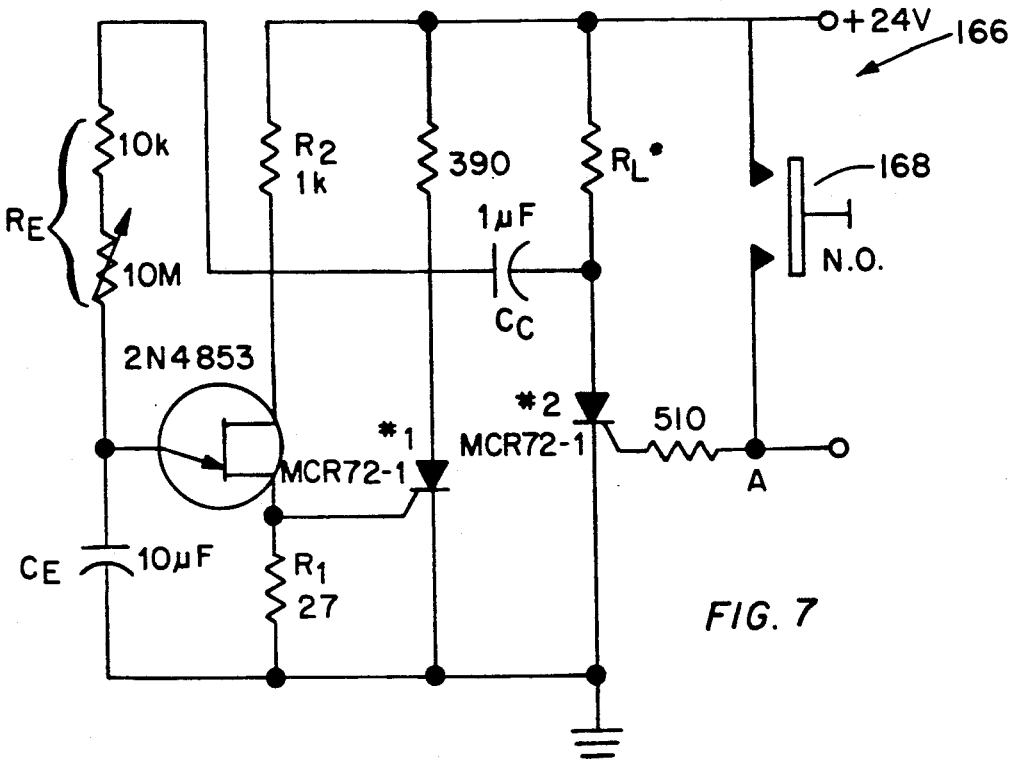
FIG. 7 is a diagram of a circuit for manually activating the rocking assembly.

As above discussed, manual operation can be set using the timer 48. An alternative to such operation is to set a specified time of operation. This can be effected using a timer circuit 166 shown in FIG. 7. This circuit is activated using manually operable switch 168. After one cycle of operation, SCR #1 will be on, and a low value of voltage is applied to the UJT emitter circuit, interrupting the timing function. When the pushbutton 168 is pushed, or a positive going pulse is applied at point A, SCR #2 will turn on, and SCR #1 will be turned off by commutating capacitor CC. With SCR #1 off, the supply voltage will be applied to RE and the circuit will begin timing again. After a period of time determined by the setting of RE, the UJT will fire and turn SCR #1 on and commutate SCR #2 off. The time delay is determined by the charge time of the capacitor. It is also noted that the value of $R_L$ must be low enough to allow hold current to flow in the SCR. The setting of $R_E$ is altered using a knob 170 on the unit.

Figure 8:
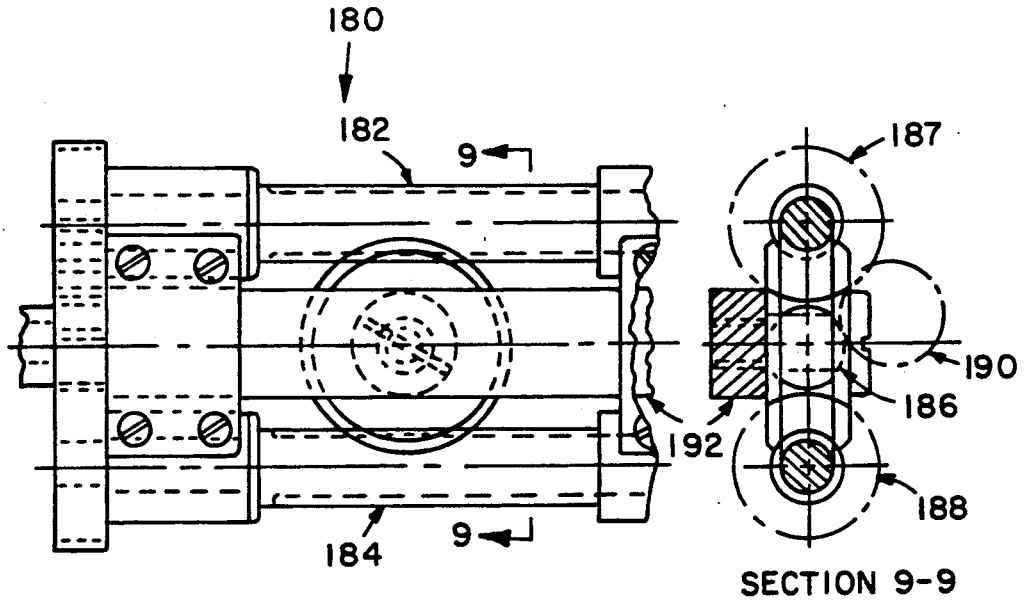
FIG. 8 is a partial side elevational view of another form of a rocking assembly mechanism for imparting up and down vertical rocking motion to a crib mattress.

An alternative form of the rocking assembly first mechanism is shown in FIGS. 8 and 9 as mechanism 180. The mechanism 180 converts fast rotary speed of driven shaft 50 into very slow straight-line motion. The mechanism 180 includes two worms 182 and 184 which differ very slightly in pitch and which mesh with opposite sides of a worm-wheel mounted on the plate 32. Worm 184 is driven directly by a pinion 186 and a gear 188 and worm 182 is revolved in the opposite direction through the provision of an idler gear 190 between pinion 186 and gear 187. The worm-wheel turns freely on a shoulder stud which is held in a slide 192. The alternative form of the rocking assembly is substituted for the elements comprising the mechanism 30 shown in FIG. 2.

In the preferred form of this mechanism, worm 84 has six threads per inch and worm 182 has 5 31/32 threads per inch, all threads being right hand. If the pitch of both worms were exactly the same, no motion would be transmitted to the slide 192, but as there is a difference in pitch equal to 1/1146 inch, the center of the worm-wheel and slide will move one-half this amount or about 0.0004 inch per revolution of the worms, or 0.0002 inch per revolution of the driving pinion 186, as the latter has 15 teeth, whereas gears 187 and 188 each have 30 teeth. When the slide 192 reaches the end of its stroke, engagement of a dog with a suitable trip operates a clutch and the traversing movement of the slide is reversed.

Figure 10:
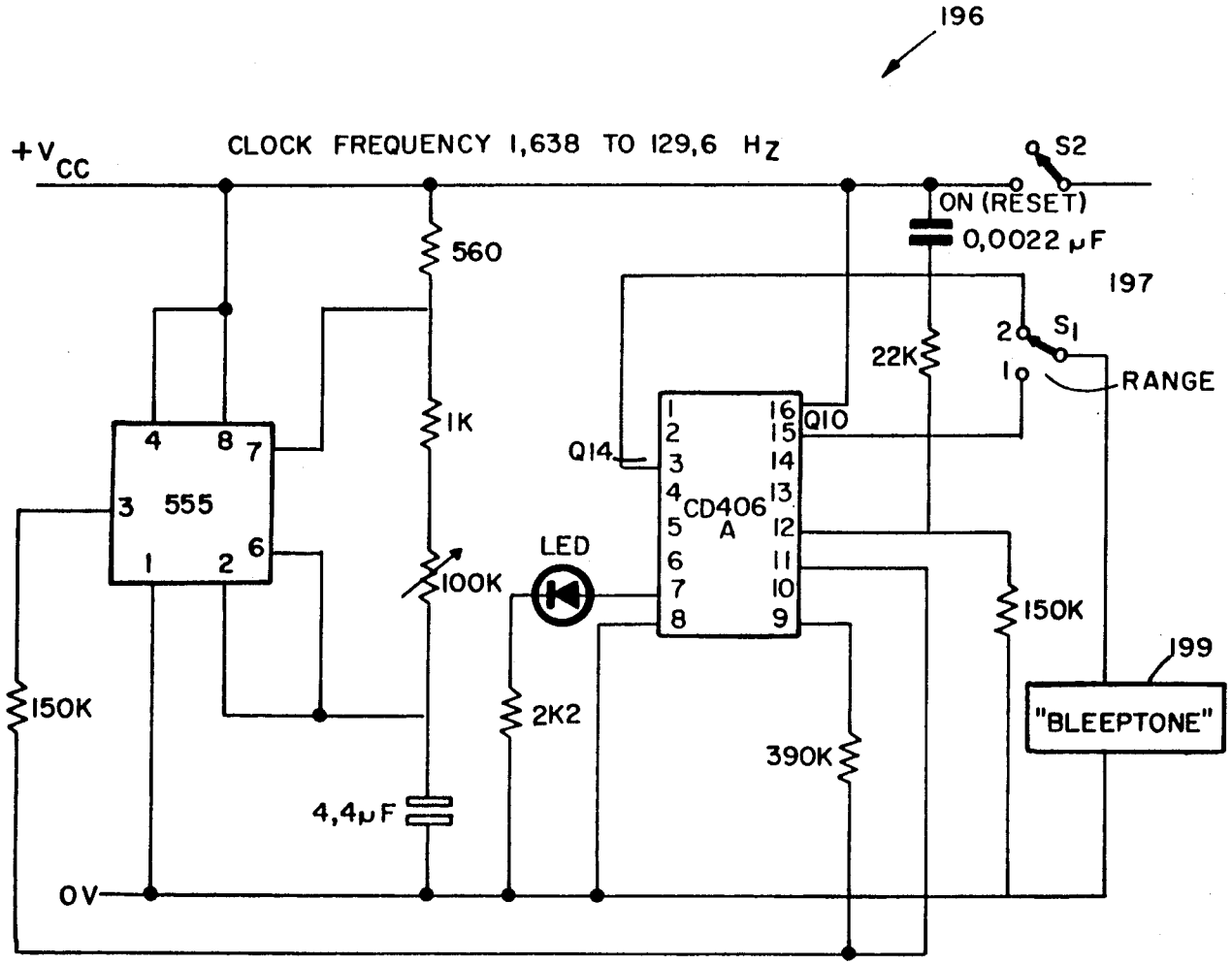
FIG. 10 is a diagram of an alarm circuit that is connected to the sound activated circuit shown in FIG. 6 for sounding an alarm if the child is crying after a predetermined time period to indicate that the automatic rocking motion has not been successful and the parent should look in on the child.

In the event that the rocking movement of the mattress is not successful in helping a child return to sleep, and the child is still crying, an adult should be notified. This objective is achieved using an alarm circuit 196 shown in FIG. 10. The circuit 196 has two ranges: 10 seconds to 5 minutes and 1 minute to 80 minutes which are selected using a manually operated selector knob 197 on the unit 44. With the LED connected as shown in FIG. 10, a reasonable frequency of flashing occurs throughout the range of operation. This circuit is reset when S2 is closed, and S2 is closed when S1 in the circuit MC shown in FIG. 5 and in circuit 152 is tripped a second time after the motor circuit is tripped once by such switch. A logic chip is connected between the switch S1 in these two circuits and the switch $S_2$ in circuit 196 to trip switch $S_2$ after switch S1 has been tripped once and then is tripped a second time by the microphone 150. This will permit the rocking motion to be continued for the preset time again, but will automatically notify an adult via bleeptone element 199 that at least one cycle of operation was unsuccessful in helping a child return to sleep.

Figure 11:
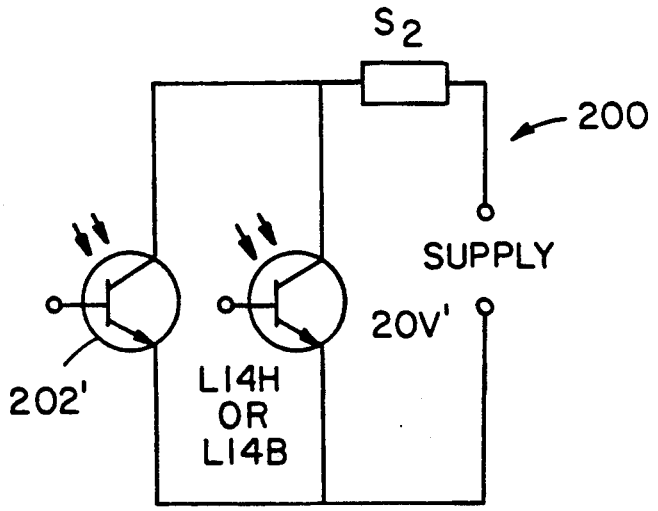
FIG. 11 is a diagram of an optically activated AND gate for activating an audible alarm in the event a rocking process does not help a child to return to sleep.
Figure 12:
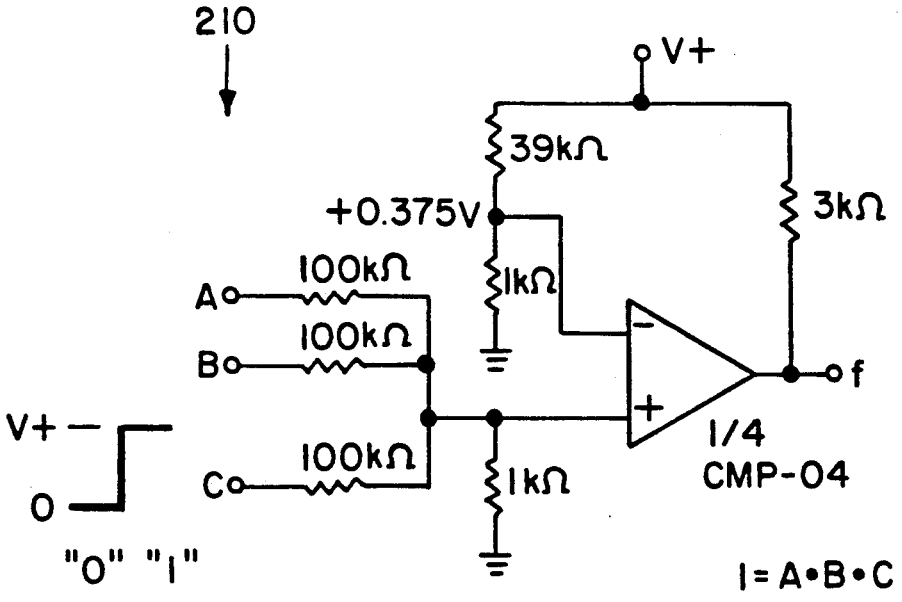
FIG. 12 is a diagram of an electrically activated AND gate for activating an audible alarm in the event a rocking process does not help a child to return to sleep.

If desired, the two cycle trip operation for circuit 197 can be achieved using an AND gate set up as indicated in either FIG. 11 or in FIG. 12. The AND gate 200 shown in FIG. 11 is activated optically and will include two light emitting elements 202 and 204 on the casing unit 44. The motor circuit includes a circuit which activates light 202 on the first operation of the motor, and then activates light 204 on the second operation of the motor. Both lights 202 and 204 are located to place incident light on the light sensing elements 202' and 204' which close switch $S_2$ when both light sensing elements have been activated.

A further alternative form of the two cycle trip circuit is shown in FIG. 12 as circuit 210. The motor circuit includes a circuit element which is shifted from "0" to "1" upon each activation of the motor by switch S1. The circuit 210 activates the switch $S_2$ when the motor has been activated twice.

Both AND gates are cleared by a manual re-set button 220 on the unit casing 44.

It is understood that while certain forms of the present invention have been illustrated and described herein, it is not to be limited to the specific forms or arrangements of parts described and shown.

I claim:

1. A crib assembly comprising:

A) a frame unit which includes a mattress-supporting element, said frame unit having an inner perimeter;

B) a mattress supported on said mattress-supporting element and having a lower surface, said mattress having an outer perimeter which is smaller than said frame unit inner perimeter; and C) a mattress rocking assembly which includes (1) a plate element supporting said mattress, (2) a first mechanism for reciprocating said plate element in a vertical direction, (3) a second mechanism for reciprocating said plate element in a horizontal direction, (4) a timer mechanism for setting a predetermined period of operation of said rocking assembly, (5) a motor connected to said first and second mechanisms and to said timer mechanism and to a source of power, and (6) activating means connected to said motor for starting said rocking assembly, said first mechanism including a motor driven output shaft connected to said motor an driven in a rotating motion when said motor is activated, a converting mechanism for converting rotation of said driven shaft into reciprocating motion and including a stationary housing member, a bushing element mounted in said stationary housing member, a shaft connected to said motor driven shaft for rotation therewith, a first truncated cylindrical element connected to said shaft for rotation therewith, a second truncated cylindrical element connected to said shaft for rotation therewith and spaced from said first truncated cylindrical element, each of said truncated cylindrical elements having a truncated face, with both of said truncated faces being parallel to each other, a bearing race mounted to said shaft, roller ball elements abuttingly interposed between each of said truncated faces and said race, a sleeve element connected to said bearing race and slidably received in said stationary housing member to reciprocate therein, said sleeve element being connected to said plate element to transfer said bearing race reciprocating motion to said plate element.

2. The crib assembly defined in claim 1 wherein said rocking assembly first mechanism further includes a swap ring assembly locking said sleeve element to said stationary housing.

3. The crib assembly defined in claim 2 wherein said swap ring assembly locks said bearing race to said sleeve element.

4. The crib assembly defined in claim 3 wherein said rocking assembly second mechanism includes an eccentric stud connected to said motor driven shaft, a sliding block pivotally connected to said eccentric stud, a box-like lever slidably connected to said sliding block and connected to said motor driven shaft, a connecting rod connected at one end thereof to said box-like lever, a bellcrank connected to another end of said connecting rod and to and edge of said plate element.

5. The crib assembly defined in claim 4 wherein said time mechanism includes a manually operable normally-open switch, a UJT, a commutating capacitor and an adjustable resistor.

6. The crib assembly defined in claim 4 wherein said timer includes an adjustable potentiometer and a capacitor electrically connected to said motor.

7. The crib assembly defined in claim 6 wherein said activating means includes a sound activated switch.

8. The crib assembly defined in claim 7 wherein said sound activated switch includes a microphone mounted on said crib frame and an amplifier element.

9. The crib assembly defined in claim 8 further including an AND gate connected to said motor.

10. The crib assembly defined in claim 9 further including two lights connected to said motor and circuit means connected to said motor to activate each light in turn when said motor is activated.

11. The crib assembly defined in claim 10 wherein said AND gate includes light actuated elements.

12. The crib assembly defined in claim 11 wherein said rocking assembly further includes a timed alarm mechanism connected to said AND gate.

13. The crib assembly defined in claim 10 wherein said AND gate includes an op amp element.

14. The crib assembly defined in claim 13 wherein said mattress rocking assembly further includes means for attaching said mattress to said mattress rocking assembly plate element.

* * * * *